US005412187A

United States Patent [19]

Walters et al.

[11] Patent Number: 5,412,187

[45] Date of Patent: May 2, 1995

[54] FUSED MICROWAVE CONDUCTIVE STRUCTURE

[75] Inventors: Glenn J. Walters, Duxbury; John A. McCormick, Lakeville, both of Mass.

[73] Assignee: Advanced Deposition Technologies, Inc., Taunton, Mass.

[21] Appl. No.: 187,446

[22] Filed: Jan. 25, 1994

[51] Int. Cl.[6] ..... H05B 6/80

[52] U.S. Cl. ..... 219/728; 219/730; 426/107; 426/243

[58] Field of Search ..... 219/728, 729, 730, 759; 426/107, 109, 234, 243; 99/DIG. 14

[56] References Cited

U.S. PATENT DOCUMENTS

| | | | |
|---|---|---|---|
| 4,320,274 | 3/1982 | Dehn | 219/728 |
| 4,904,836 | 2/1990 | Turpin et al. | 219/730 |
| 4,992,636 | 2/1991 | Namiki et al. | 219/728 |
| 5,079,397 | 1/1992 | Keefer | 219/730 |
| 5,173,580 | 12/1992 | Levin et al. | 219/730 |
| 5,278,378 | 1/1994 | Beckett | 219/728 |

*Primary Examiner*—Philip H. Leung
*Attorney, Agent, or Firm*—Wolf, Greenfield & Sacks

[57] ABSTRACT

A conductive structure for use in microwave food packaging which adapts itself to heat food articles in a safer, more uniform manner is disclosed. The structure includes a conductive layer disposed on a non-conductive substrate. Provision in the structure's conductive layer of fuse links and base areas causes microwave induced currents to be channeled through the fuse links, resulting in a controlled heating. When over-exposed to microwave energy, fuses break more readily than the conductive base areas resulting in less absorption of microwave energy in the area of fuse breaks than in other regions where fuses do not break. In this way the fused microwave conductive structure compensates for the uneven microwave field within a microwave oven and at the same time provides a safer conductive structure less likely to overheat. In addition, by varying the dimensions of the fuse links and base areas it is possible to design and fabricate different fused microwave conductive structures having a wide range of heating characteristics. Thus, a fused microwave conductive structure permits food heating temperatures to be tuned for food type.

29 Claims, 2 Drawing Sheets

FUSED MICROWAVE CONDUCTIVE STRUCTURE

FIELD OF THE INVENTION

The present invention relates generally to the field of microwave conductive structures for improving the cooking, heating or browning of food in microwave ovens. More particularly, the invention relates to articles usable in conventional food packaging which interact with electromagnetic energy generated by the microwave oven and adapt to different microwave oven types, food compositions and food geometries.

BACKGROUND

An example of a microwave conductive structure is a microwave susceptor which is an article which absorbs microwave energy, converts it into heat and conducts the heat generated into food articles placed in close proximity thereto. Microwave susceptors are particularly useful in microwave food packaging to aid in browning or crisping those foods which are preferably prepared in that way.

The field of microwave conductive packaging technology includes numerous attempts to optimize heating, browning and crisping of food cooked in microwave ovens. Such attempts include the selectively microwave-permeable membrane susceptor shown in prior U.S. Pat. No. 5,185,506, issued Feb. 9, 1993 and U.S. Pat. No. 5,245,821 issued Oct. 19, 1993. Other attempts include a microwaveable barrier film described in U.S. Pat. No. 5,256,846 issued Oct. 26, 1993 and a microwave diffuser film described in U.S. patent application Ser. No. 07/756,165. U.S. Pat. Nos. 5,185,506 and 5,245,821 disclose examples of constructions which modify the overall heating pattern in a microwave oven in an attempt to optimize the heating for a specific food product and geometry. However, these and conventional microwave susceptor structures do not adequately address the heating problems associated with non-uniform electromagnetic fields found in all microwave ovens.

The unpredictability of the microwave field within a microwave oven is a significant problem for articles and methods which attempt to make heating, browning or crisping of food uniform. There are more than 500 models of microwave ovens on the market today, all of which have different heating patterns and non-uniform energy fields. Since most food products themselves are non-uniform in size and shape, there is an increased natural tendency of food to heat unevenly. The inability to adequately predict locations of hot spots and cold spots within a microwaved, packaged food item including a susceptor has made this area the subject of much research. For example, fishsticks or french fries loosely packaged in a box containing a six-inch by six-inch susceptor on the bottom, are often not properly crisped. After exposure to the microwave field in a microwave oven, there will be noticeable differences in the heat generated by the 36-inch square susceptor, depending on the location of the food product. For instance, wherever the food product does not cover the susceptor material, the susceptor will get extremely hot, often hot enough to cause damage to the package. Indeed, it has been reported that susceptor packages have caught fire in consumer microwave often. On the edges of the food product, there will also be extremely high temperatures relative to the center of the food product. However, on the edges of the food product, there will be lower temperatures than those susceptor areas which are not covered by food product. The net result is that the heat gain of the susceptor is not balanced over the susceptor area.

Therefore, one goal of the present invention is to provide a microwave conductive structure which exhibits enhanced safety and performance over existing commercial microwave susceptors, and a second goal is to provide a microwave conductive structure which adapts itself in a controlled manner on the basis of the oven, food geometry, food location and food composition, so as to provide more uniform heating, browning and crisping of food products.

SUMMARY OF THE INVENTION

The above general goals and such other goals as will be obvious to those skilled in the art are met in the present invention, wherein there is provided a fused microwave conductive structure.

A fused microwave conductive structure for use in food packaging, may comprise a substrate layer and an electrically conductive layer deposited on a surface of the substrate layer. The conductive layer has fuse links with connect adjacent conductive base areas. Base areas serve as conductive paths between fuse links, and act in connection with the fuse links to generate heat on exposure to microwave energy. Base areas are less susceptible to breaking upon exposure to microwave energy than the fuse links, which are substantially susceptible to such breaking. A wide variety of shapes and sizes of both the fuse links and base areas are possible. Suitable sizes and shapes for the fuses and the bases are determined empirically for different food and package types.

BRIEF DESCRIPTION OF THE DRAWING

Embodiments of the present invention will now be discussed in connection with the figures. Like reference numerals indicate like elements in the figures, in which.

DETAILED DESCRIPTION

The present invention will be better understood in view of the following description, read in connection with the figures.

Microwave conductive structures, including microwave susceptors used in food packaging generally include a non-conductive substrate on which a conductive layer is disposed. The structure may be enclosed within layers of non-conductive material suitable for contact with food articles during cooking. Microwave energy impinging on such a structure induces currents within the conductive layer. The currents are dissipated by the resistance of the conductive layer as heat energy, which may be conducted into food articles placed in close proximity thereto. The present invention is of this general type.

Figure 1A:
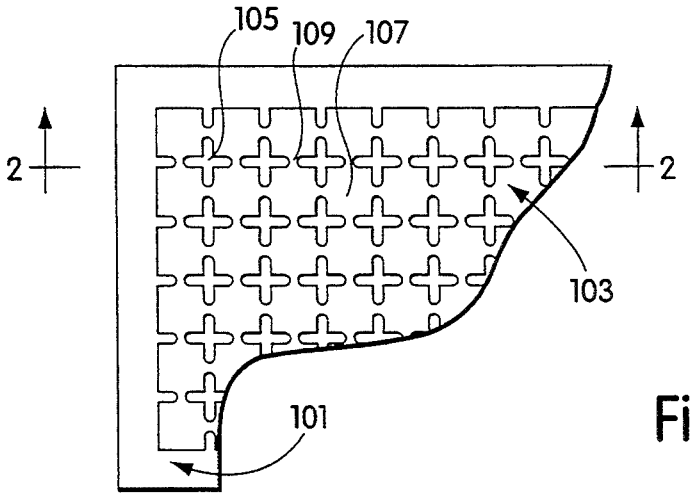
FIGS. 1A, 1B and 1C are conductive structure patterns according to various embodiments of the present invention.
Figure 2:
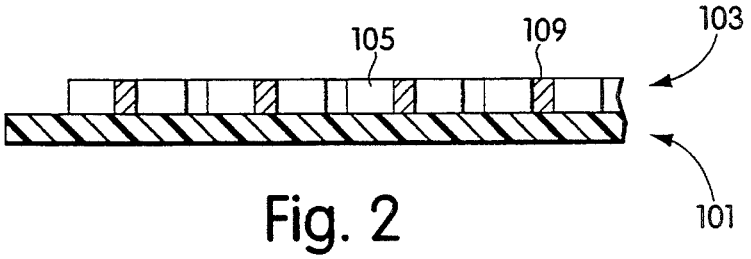
FIG. 2 is a section of the embodiment of FIG. 1A, taken along line 2—2.

A first embodiment of the present invention is now described in connection with FIG. 1A. FIG. 1A shows a fused microwave conductive structure comprised of a plastic substrate, generally designated 101, and a electrically conductive layer, generally designated 103. The layers 101 and 103 may be more clearly seen in the cross-section of FIG. 2.

The substrate layer 101 may be made of any plastic conventionally used for food packaging purposes and which is not susceptible to damage as a result of the application of a thin film of metal or other conductive material. The conductive layer 103 may be formed of any metal or alloy conventionally used for microwave conductive structures. The conductive layer 103 should have a surface resistivity in a range of about 10Ω/□ to 1000Ω/□. One advantage of the present invention is that it is more tolerant of variations in conductive layer thickness. Other advantages may include, but are not limited to greater heat flux than current susceptors, safer more uniform heating and lower and higher temperature conductive structures. Suitable metals include aluminum, iron, tin, tungsten, nickel, stainless steel, titanium, magnesium, copper and chromium or alloys thereof. The conductive layer 103 may include metal oxide or be partially oxidized or may be composed of another conductive material, so as to adjust the layer properties.

Conductive layer 103 is provided with a plurality of non-conductive areas 105, such as holes or areas of non-conductive materials, conductive base areas 107 and fuse links 109, for example. The fuse links 109 connect base areas 107 each to the other.

The base areas, 107, can be large enough to function individually as microwave susceptors. Alternatively, they can be too small to individually act as microwave susceptors and heat up significantly on exposure to microwave energy. However, a group of such small areas, linked together by fuse links, 109, converts microwave energy into heat as though it were one large susceptor. As will be explained in greater detail below, if one area (FIG. 3, 300*a*) of the susceptor is over-exposed to microwave energy, fuse links in that area will break, isolating that area from other areas (FIG. 3, 300*b*) of the conductive structure. As a result, those areas (FIG. 3, 300*a* and 300*b*) will cease to operate effectively as a microwave susceptor and will cool significantly.

Failure of the fuse links is a function of the supporting substrate, the thickness of the conductive layer 103, the constituent material of the conductive layer, the dimensions of the pattern defining the fuse links 109 and the dimensions of the base areas 107 as well as variables related to the food, the location of the food within the oven cavity and the oven type. Furthermore, fuse links may develop small cracks that permit displacement currents to flow through the cracks possibly in a capacitive coupling fashion, before failing entirely. This, and other factors, discussed below, permit the design of fast and slow fuses, and high heating and low heating fuses. Pattern dimensions and corresponding fuse link behavior is presently determined on an empirical basis. Fuse links covering an area of about 0.1 $mm^2$ to 20 $mm^2$ are suitable.

A number of patterns have been proposed, which represent various embodiments of the present invention. For example, the patterns shown in FIGS. 1B and 1C will produce different degrees of heating of food articles and fuse links, both before and after fuse links break. The pattern of FIG. 1B may be characterized as having slow, hot fuses 109, whereas the pattern of FIG. 1C may be characterized as having fast, cool fuses 109. This difference in fuse behavior arises as follows.

Figure 1B:
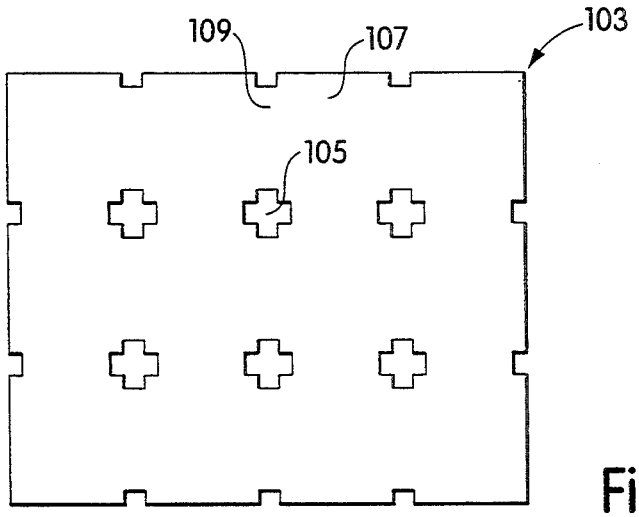
Figure 1C:
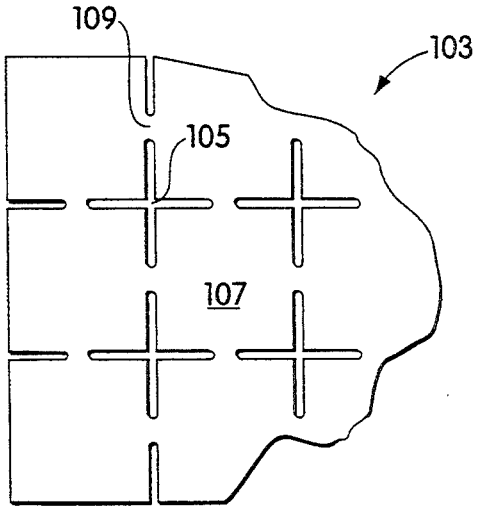

Fuse links function as conventional fuses; that is, a fuse with a larger conductive cross-section than a second fuse requires greater current to fail than that required to make the second fuse to fail. With the same conductive layer thickness, wider fuse links having corresponding larger cross-sectional areas and connecting adjacent base areas, fail at higher temperatures than narrower fuse links due to increased current capacity. These wider fuse links also take longer to reach failure temperature. In FIG. 1B, the fuse is wider than the distance between opposite edges of the adjacent non-conductive area, resulting in a slow, hot fuse. In FIG. 1C, the fuse is narrower than the distance between opposite edges of the adjacent non-conductive area, resulting in a fast, cool fuse, because the current carrying capacity of the fuse is decreased. It should be understood that the particular patterns illustrated are not intended to limit the claimed invention, but rather are intended to show some of the numerous possible designs embodying the present invention.

Figure 3:
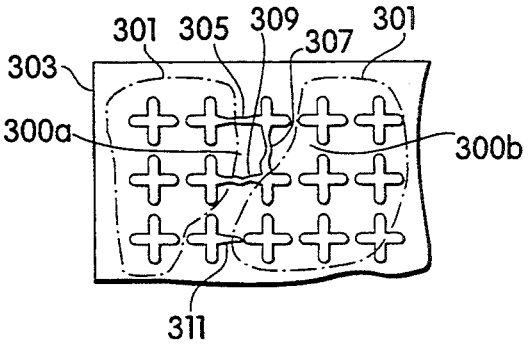
FIG. 3 is a top view of a conductive structure which has been exposed to microwave energy, while food is present thereon.

In FIG. 3, the effect of irregularly shaped food articles on a conductive structure according to the present invention is seen. Food articles 301, shown in phantom, are placed on a conductive structure 303, in accordance with the present invention. Fuse links 305, 307 and 309 are exposed directly to microwave energy. Therefore, they break, isolating portions 300*a* and 300*b* of the conductive structure 303 from one another. The microwave energy absorbed in the region near broken fuse links 305, 307, 309 and subsequently converted into heat is reduced. Fuse link 311, being partially covered by a food article 301 has partially broken. Thus, microwave heating of those areas of conductive structure 303 has been partially reduced. Since less microwave energy is absorbed by the regions of conductive structure 303 where fuses have broken, the solid regions of conductive structure 303 under food articles 301 now absorb relatively more microwave energy and produce more heat. Therefore, the effectiveness of conductive structure 303 in the areas covered by food articles 301 has been enhanced.

Figure 4:
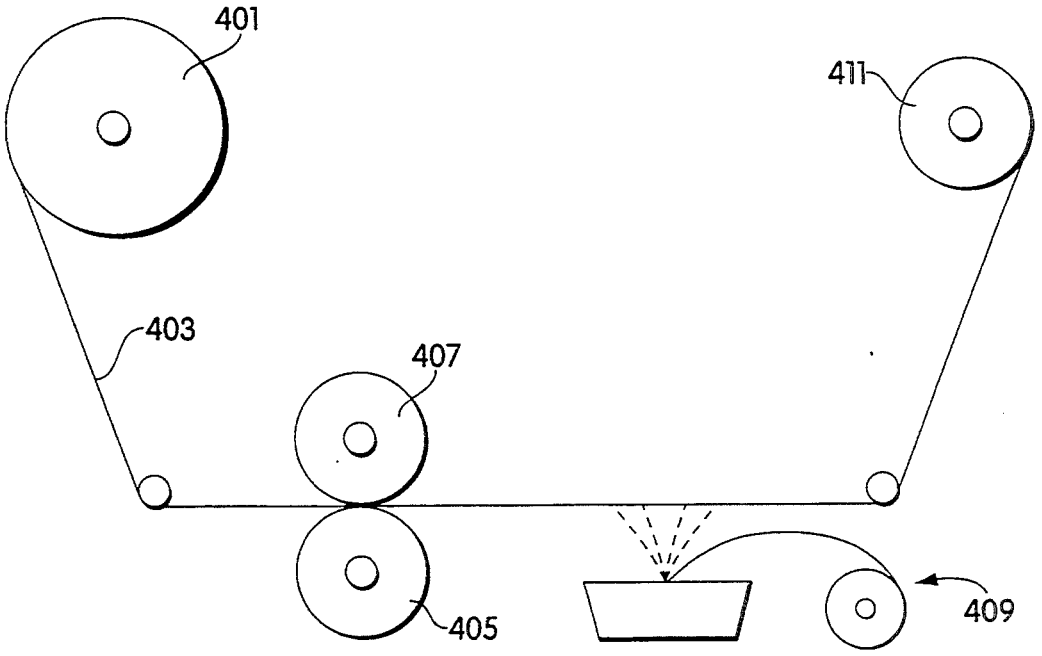
FIG. 4 is a schematic illustration flow chart of a method for making a conductive structure in accordance with one aspect of the present invention.

Conductive structures in accordance with the present invention may be made by a variety of methods known to those skilled in the art. In general, any method which can produce a thin pattern film of metal on a plastic substrate is suitable. For example, pattern printing and etching techniques are suitable. Another such method is now described in connection with FIG. 4.

In accordance with this method, there is supplied from a supply reel 401 a continuous web of plastic substrate 403. The plastic substrate 403 is passed between rollers 405 and 407 which cause to be printed on a bottom surface thereof a negative image in oil of the desired pattern. The plastic substrate 403 then passes above an aluminum deposition apparatus 409. The pattern of oil printed by rollers 405 and 407 locally prevents deposition of metal. Metal is, however, deposited to regions not covered by the oil. Thus, take-up reel 411 receives a substrate on which a conductive structure film has been deposited having, for example, one of the patterns shown in FIGS. 1A–1C.

Another example of a method for producing conductive structures according to the present invention is to deposit a uniform film of metal on a substrate and subsequently etch metal away to form the pattern required.

The present invention has now been described in connection with a number of specific embodiments thereof. However, numerous modifications which are contemplated as falling within the scope of the present invention should now be apparent to those skilled in the art. Therefore, it is intended that the scope of the present invention be limited only by the scope of the claims appended hereto.

What is claimed is:

1. A patterned conductive structure for use in microwave food packaging, the structure comprising:

a substrate material; and a conductive layer disposed on a surface of the substrate material, the conductive layer having a plurality of apertures defining at least one fuse link and at least two base areas, the base areas linked to each other by said at least one fuse link which is more susceptible to breaking upon exposure to microwave energy than the base areas.

2. The fused microwave conductive structure of claim 1, wherein the fuse links each cover an area in a range of 0.1 $mm^2$ to 20 $mm^2$.

3. The fused microwave conductive structure of claim 1, wherein the conductive layer has a surface resistivity in a range of 0.5Ω/□–1000Ω/□.

4. The fused microwave conductive structure of claim 1, wherein the conductive layer is aluminum and has a surface resistivity in a range of 1.0Ω/□–200Ω/□.

5. The fused microwave conductive structure of claim 4, wherein the fuse links each cover an area in a range of 0.1 $mm^2$ to 20 $mm^2$.

6. A patterned conductive structure as in claim 1 wherein the conductive layer comprises aluminum.

7. A patterned conductive structure as in claim 1 wherein the substrate material comprises a dielectric plastic film.

8. A patterned conductive structure as in claim 1 further comprising at least one layer of a non-conductive material laminated to one side of the structure.

9. A patterned conductive structure as in claim 1 enclosed within layers of non-conductive material.

10. A patterned conductive structure for use as a microwave susceptor in food packaging, the structure comprising:

a substrate material; and a conductive layer disposed on a surface of the substrate material, the conductive layer having a plurality of apertures defining at least one fuse link and at least two base areas linked by said at least one fuse link, the base areas characterized in that, upon exposure to a microwave energy field, they heat to a first temperature if connected by said at least one fuse link and to a second temperature if not connected by said at least one fuse link, the first temperature being higher than the second temperature.

11. A patterned structure as in claim 10, wherein the fuse links each cover an area in a range of 0.1 $mm^2$ to 20 $mm^2$.

12. A patterned structure as in claim 10, wherein the conductive layer has a surface resistivity in a range of 0.5Ω/□–1000Ω/□.

13. A patterned structure as in claim 10, wherein the conductive layer is aluminum and has a surface resistivity in a range of 1.0Ω/□–200Ω/□.

14. A patterned structure as in claim 13, wherein the fuse links each cover an area in a range of 0.1 $mm^2$ to 20 $mm^2$.

15. A patterned conductive structure as in claim 10 wherein the conductive layer comprises aluminum.

16. A patterned conductive structure as in claim 10 wherein the substrate material comprises a dielectric plastic film.

17. A patterned conductive structure as in claim 10 further comprising at least one layer of a non-conductive material laminated to one side of the structure.

18. A patterned conductive structure as in claim 10 enclosed within layers of non-conductive material.

19. A microwave susceptor for use in packaging of a microwaveable food product which comprises:

a dielectric substrate material;

a first region having a conductive layer disposed on a surface of the substrate material, the conductive layer having apertures which define at least one fuse link and at least two base areas, the base areas linked to each other by said at least one fuse link, and a second region having at least two isolated base areas.

20. A microwave susceptor as in claim 19 wherein the first region heats to a temperature higher than the second region when exposed to a microwave energy field.

21. A microwave susceptor as in claim 19 wherein the second region is formed by the failure of a fuse link connecting at least two base areas.

22. A microwave susceptor as in claim 19, wherein the fuse links each cover an area in a range of 0.1 $mm^2$ to 20 $mm^2$.

23. A microwave susceptor as in claim 19, wherein the conductive layer has a surface resistivity in a range of 0.5Ω/□–1000Ω/□.

24. A microwave susceptor as in claim 19, wherein the conductive layer is aluminum and has a surface resistivity in a range of 1.0Ω/□–200Ω/□.

25. A microwave susceptor as in claim 24, wherein the fuse links each cover an area in a range of 0.1 $mm^2$ to 20 $mm^2$.

26. A microwave susceptor as in claim 19 wherein the conductive layer comprises aluminum.

27. A microwave susceptor as in claim 19 wherein the dielectric substrate material comprises a plastic film.

28. A microwave susceptor as in claim 15, further comprising at least one layer of a non-conductive material laminated to one side of the susceptor.

29. A microwave susceptor as in claim 15 enclosed within layers of non-conductive material.

* * * * *

UNITED STATES PATENT AND TRADEMARK OFFICE

CERTIFICATE OF CORRECTION

PATENT NO. : 5,412,187

DATED : May 2, 1995

INVENTOR(S) : Walters et al.

It is certified that error appears in the above-indentified patent and that said Letters Patent is hereby corrected as shown below: Title page, item [56], Please include the prior art cited in an Information Disclosure Statement filed April 25, 1994, under References Cited for U.S. Patent No. 5,412,187.

U.S. PATENT DOCUMENTS

| | | | |
|---|---|---|---|
| 5,185,506 | 2/93 | Walters | 219/10.55 |
| 5,220,143 | 1/93 | Kemske et al. | 219/10.55 |

FOREIGN PATENT DOCUMENTS

| | | |
|---|---|---|
| 2072286 | 12/92 | Canada |

OTHER PUBLICATIONS

In re Blamer, 93-1108, (CAFC 1993). Decision cites USPTO BPAI decision of July 29, 1992 in Appeal No. 92-1802. Invention of Blamer is characterized in this decision.

Signed and Sealed this

Twelfth Day of September, 1995

*Attest:*

Bruce Lehman

BRUCE LEHMAN

*Attesting Officer*

*Commissioner of Patents and Trademarks*